US005265355A

United States Patent [19]

Daniels

[11] Patent Number: 5,265,355

[45] Date of Patent: Nov. 30, 1993

[54] REAR-MOUNTED SNOW PLOW APPARATUS

[75] Inventor: Gregory J. Daniels, East Dundee, Ill.

[73] Assignee: Daniels Pull Plow, Inc., East Dundee, Ill.

[21] Appl. No.: 990,439

[22] Filed: Dec. 15, 1992

[51] Int. Cl.[5] ..... E01H 5/04

[52] U.S. Cl. ..... 37/231; 37/234; 37/236; 37/268

[58] Field of Search ..... 37/231, 236, 268, 234, 37/235, 269

[56] References Cited

U.S. PATENT DOCUMENTS

| | | | |
|---|---|---|---|
| 4,249,323 | 2/1981 | Mathis et al. | 37/236 X |
| 4,403,432 | 9/1983 | Biance | 37/268 X |
| 4,439,939 | 4/1984 | Blau | 37/235 X |
| 4,907,357 | 3/1990 | Lilienthal | 37/236 X |
| 5,046,271 | 9/1991 | Daniels | 37/268 X |
| 5,058,295 | 10/1991 | Holland | 37/268 |

*Primary Examiner*—Dennis L. Taylor
*Assistant Examiner*—J. Russell McBee
*Attorney, Agent, or Firm*—Olson & Hierl, Ltd.

[57] ABSTRACT

An improved universal adjustable snow plow apparatus that is connectable to a vehicular rear for plowing snow and the like. The plow apparatus employs a plow blade with a pair of vertically oriented plate supports; a stabilizing and supporting subassembly including a horizontal draw bar and a post; an elevating subassembly including a pair of spaced stabilizing arms and fluidic cylinder actuated pair of end adjacent adjoining links; and a cooperating plow orientation adjustment system. This adjustment system includes plow tilt regulating means and plow height regulating means. The blade is preferably provided with a replaceable elongated ground engaging scraper bar.

12 Claims, 3 Drawing Sheets

REAR-MOUNTED SNOW PLOW APPARATUS

TECHNICAL FIELD

This invention relates to an improved snow plow apparatus including an adjustable plow blade mounted to the rear portion of a vehicle.

BACKGROUND OF THE INVENTION

My U.S. Pat. No. 5,046,271 which issued on Sep. 10, 1991 relates to a rear-mounted snow plow apparatus adapted for plowing near a permanent structure, or the like. This apparatus includes a plow, a plow supporting means and a plow elevating mechanism for raising and lowering the plow. A hydraulic subsystem is included for operating the elevating mechanism.

The plow apparatus of my U.S. Pat. No. 5,046,271 is believed to be a significant and useful advance in the snow plow art. The elevating mechanism and its associated hydraulic subsystem are particularly effective. However, certain features of this plow apparatus need to be improved to achieve an even more satisfactory and reliable structure.

For example, I have discovered that an improved plow position adjustment means is needed because, under certain operating conditions, greater and more reliable plow adjustability is needed. Also, the plow pulling arms can sometimes become broken away from the plow blade under certain conditions involving applied shear force, including the sudden application of impact force against the blade during use.

Further, because of certain spatial orientations that the plow blade can assume in certain use conditions, the ground-engaging edge thereof can experience wear or edge damage through contact with stones or the like. Still further, the snow plow apparatus needs to be simply and readily associatable with a vehicle hitch without having to make time consuming, awkwardly located interconnections between the plow pulling arms and the vehicle hitch.

These potential disadvantages need to be overcome without basic alteration of the plow elevating mechanism including its associated hydraulic subsystem.

The present invention overcomes all of these disadvantages while retaining the basic plow elevating mechanism.

SUMMARY OF THE INVENTION

The present invention relates to an improved universal adjustable snow pull plow apparatus for coupling to the rear of a vehicle.

The term "universal" refers to the fact that the snow plow apparatus is adapted for coupling to the rear of most vehicles regardless of the height of the vehicle above the ground.

The inventive snow plow apparatus is modular in structure to allow easy replacement of parts and components, and also to accommodate cooperative means for adjusting the plow height and tilt with respect to the ground surface to be plowed.

The inventive snow plow apparatus advantageously retains the hydraulically driven plow elevating subsystem of my foregoing U.S. Pat. No. 5,046,271.

The inventive snow plow apparatus is provided with a new and surprisingly effective plow position adjustment means which not only avoids breakage problems of the plow blade support arm means, but also achieves substantially greater plow adjustment capability and reliability.

The inventive snow plow apparatus is also provided with a new and readily replaceable ground engaging scraper bar structure for the plow blade which facilitates use of the plow blade at its various possible positions The scraper bar structure is readily replaceable when and if worn or damaged.

The inventive snow plow apparatus also provides a new and simple connection means between the plow pulling arms and the plow blade so that arm breakage is eliminated. Moreover, this new connection means provides tilt adjustability for the plow blade.

The snow plow apparatus further provides the capacity for height adjustment of the plow blades. Thus, this plow apparatus can be used with various vehicles wherein hitch height above the ground is variable from vehicle to vehicle. Height adjustment is positive and no slipping can occur during use.

The present snow plow apparatus is mechanically self-contained so that only one connection (using two belts or the like) is needed between a vehicle hitch and the snow plow apparatus. There is no need for auxiliary connections between hitch portions and plow pulling arms, for example Thus, the foregoing potential disadvantages of my previous plow apparatus are overcome without alteration of the desirable features. The resulting improved universal adjustable snow plow apparatus comprises a combination which is not disclosed or suggested in my U.S. Pat. No. 5,046,271 and which displays superior use and operational performance characteristics.

The improved snow plow apparatus comprises in combination a plow means, a plow stabilizing and supporting means, a plow elevating means and a cooperating plow orientation adjustment means. The plow means includes a horizontally elongated blade means, a pair of opposite end plates and a pair of forwardly projecting, spaced vertically oriented plate support means.

The plow stabilizing and supporting means includes a horizontally extending draw bar means and a vertically extending post means.

The plow elevating means includes a pair of stabilizer arms, an articulated link means and fluidic cylinder means (preferably hydraulic) engaged with the link means for raising and lowering the plow means.

The plow orientation adjustment means includes plow means, tilt regulating means and plow height regulating means. For tilt regulating, an arcuate slot in each plate support means is aligned with an aperture in each stabilizer arm and clamping means holds each arm at a desired position relative to the adjacent slot.

For height regulating, one of a plurality of vertically spaced holes in the post means is aligned with a supporting hole in a post support bar and the alignment is maintained by retaining pin means.

Thus, tilt and height are regulated in a simple, easily adjustable and reliable manner without interfering with the plow supporting or elevating operations.

Other and further objects, aims, purposes, advantages, features, and the like of the present invention will be apparent from the following embodiment description taken with the accompanying drawings and the appended claims.

DETAILED DESCRIPTION

Figure 1:
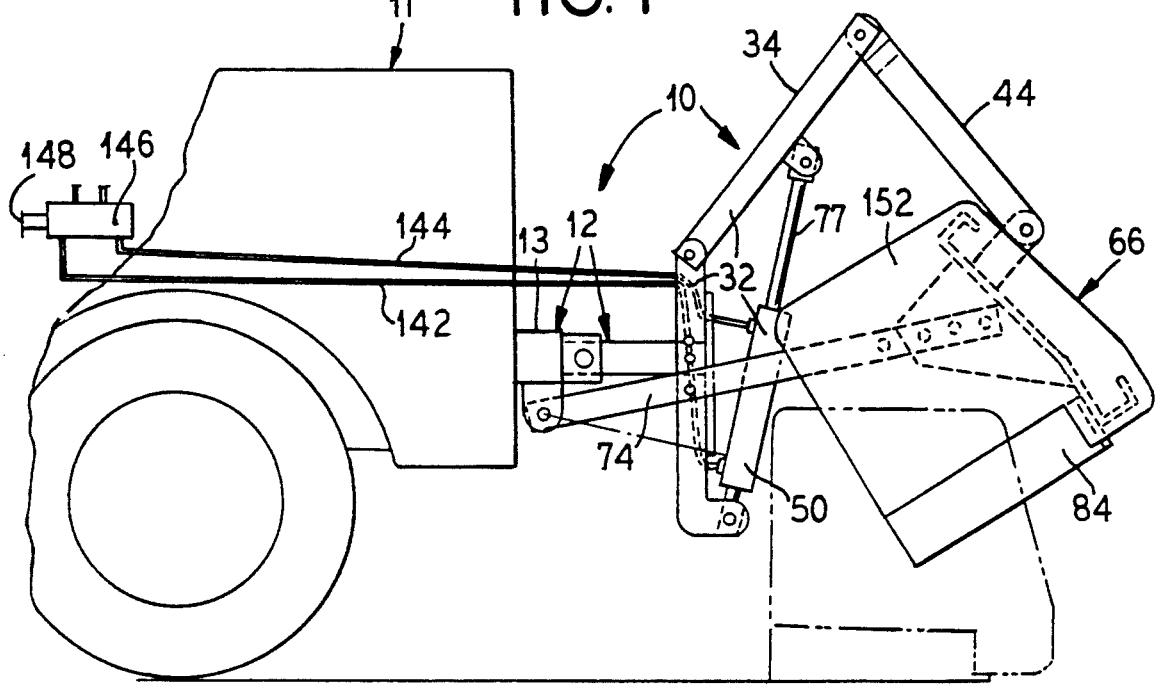
FIG. 1 is a side elevational view of one embodiment of a pull plow of the invention coupled to the rear of a motor vehicle showing the plow both in a raised position for travel and also in phantom in a lowered position for plowing operations.

Referring to the Figures, there is seen one embodiment 10 of a plow apparatus of the present invention. The plow apparatus embodiment 10 includes subassembly means for adjusting the height and pitch (or tilt) of the plow means with respect to a ground surface to be plowed. The plow apparatus 10 is substantially modular for ease in adjustment and for simplifying the replacement of parts and components.

The plow apparatus 10 has a plow subassembly 66 that incorporates a horizontally elongated blade member 58 having a front face 58A and a back face 58B. The blade member 58 is provided with a pair of end plates 150 and 152, each one being generally vertically oriented and secured by welding or the like to a different opposite end of the blade member 58. The end plates 150 and 152 cooperate with the blade member 58 to define three side portions of a type of holding region within which material being plowed can collect during plowing.

The blade member 58 is also provided with a pair of plate supports 114 and 116. Each plate support has a front edge portion 128 and a rear edge portion 124. The rear edge portion 124 of each plate support 114 and 116 is secured by welding or the like to the front face 58A of blade member 58 with the plate supports 114 and 116 each being generally vertically oriented and in horizontally spaced, symmetrical relationship relative to each other and to the blade member 58. These plate supports 114 and 116 support and reinforce the blade member 58, associate with the arms 74 (as described below) and permit pivotal (tilting) adjustments of the blade member 58 (as also described below).

The plow subassembly 66 most preferably also incorporates a ground engaging, replaceable, elongated, flattened scraper bar 82 which has forwardly turned terminal opposite end portions 80 and 84 and which is configured to extend continuously along the lower edge portions of the end plates 150 and 152 and of the blade member 58. The scraper bar 82 is secured to the edge portions by a plurality of retaining clips, such as clips 86, 87, 88 and 89 which are retained by nut and bolt assemblies 153 or the like (not detailed) to end plates 150 and 152, and by a plurality of nut and bolt assemblies 151 to the overlapping edge portions of blade member 58.

Figure 3:
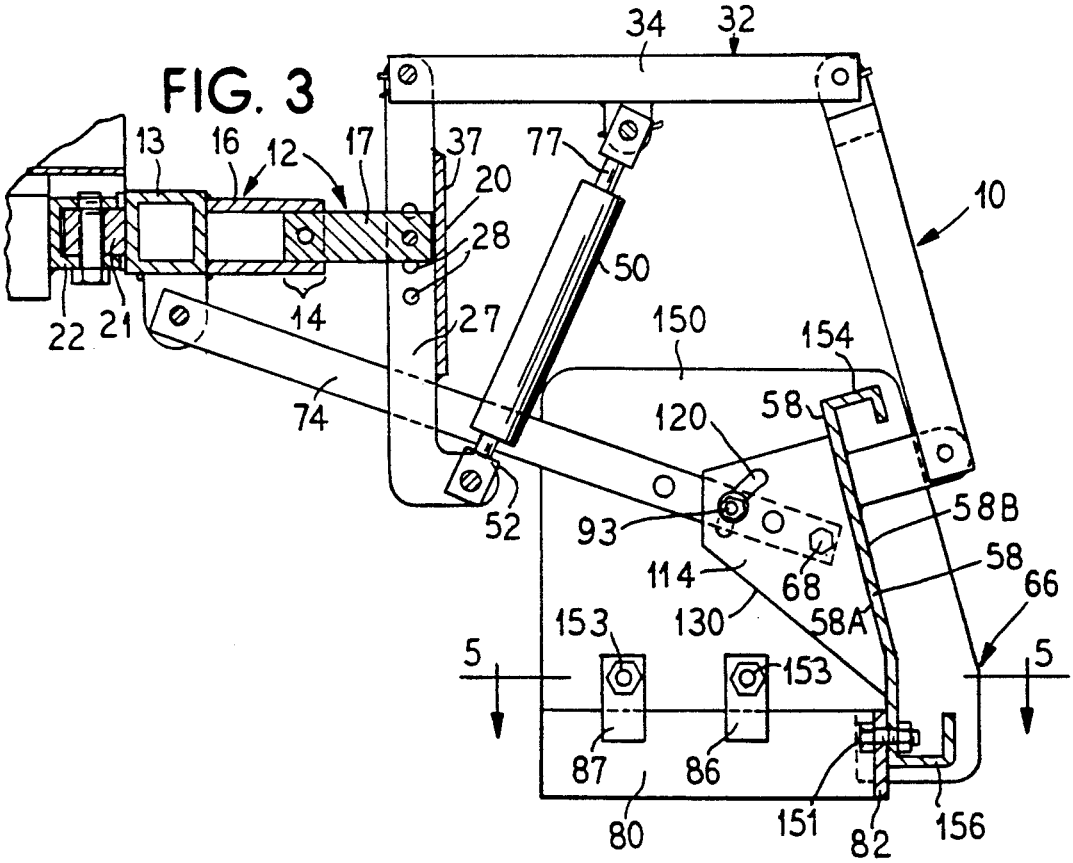
FIG. 3 is an enlarged, medial, longitudinal vertical sectional view taken generally along the line 3—3 of FIG. 2.
Figure 2:
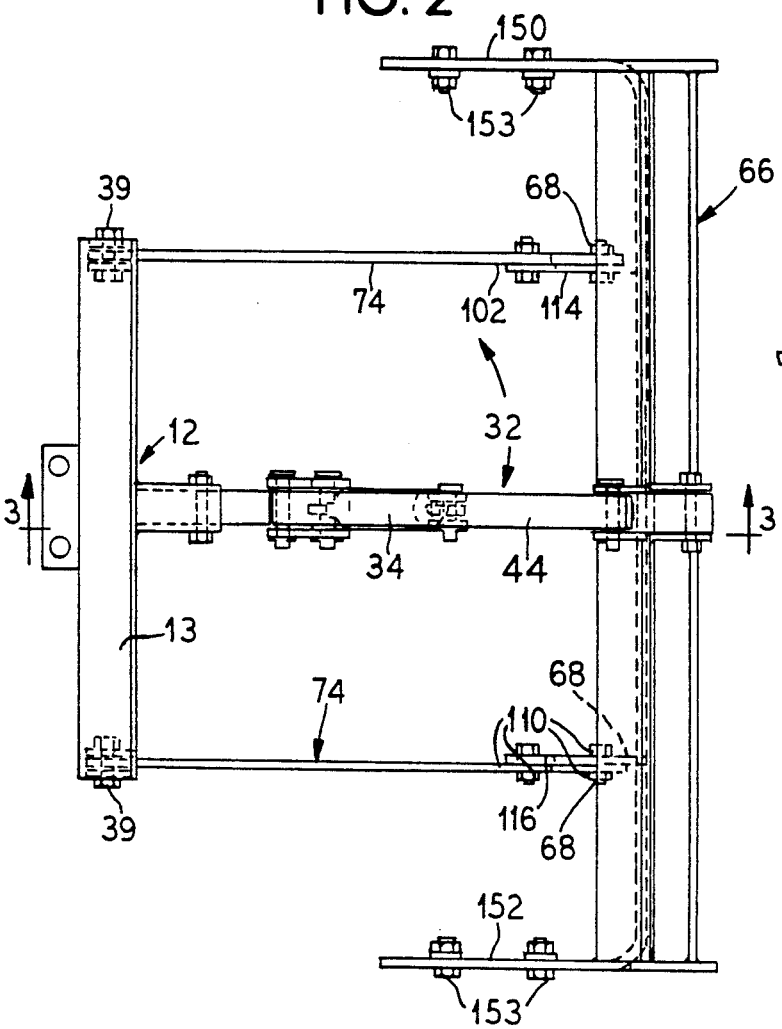
FIG. 2 is a top plan view of the pull plow of FIG. 1.
Figure 6:
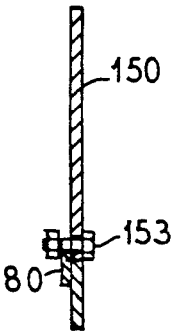
FIG. 6 is a fragmentary vertical sectional view taken substantially along line 6—6 of FIG. 5.
Figure 5:
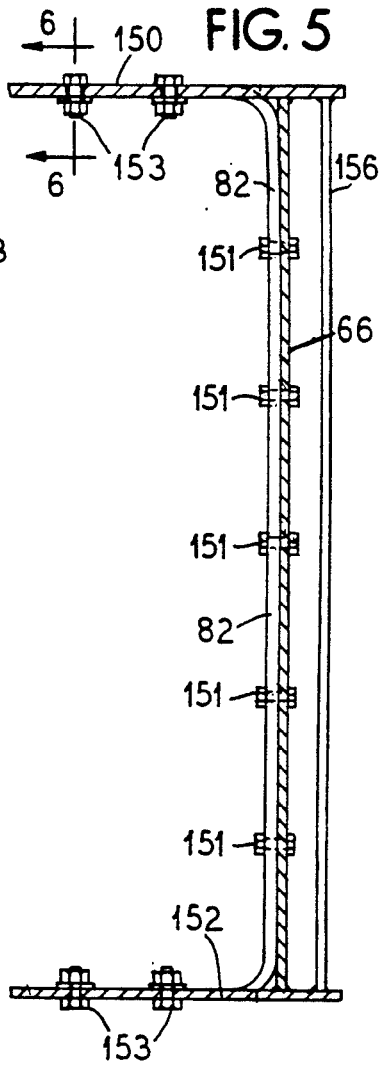
FIG. 5 is a transverse view taken substantially along line 5—5 of FIG. 3.

As shown in FIGS. 1 and 3, vehicle 11, which can be a pick-up truck or the like, has conventionally mounted in and under the rear thereof a permanently mounted hitch 15. Hitch 15 includes a pair of vehicle body mounted support members (conventional, not shown, but see, for example, my above-referenced U.S. Pat. No. 5,046,271). A cross beam, preferably a U-bar 22, is welded or otherwise secured to the support members to provide a stable weight and load bearing structure for association with the snow plow apparatus 10.

The plow apparatus 10 includes a horizontally extending draw bar 13 which preferably is cross-sectionally square. The forward vertical face of bar 13 has a tongue bar 21 centrally welded or otherwise secured thereto. The tongue bar 21 is located and dimensioned so as to be slidably engagable the rearward opening edge of the U-bar 22. When so engaged, a pair of bolts 23 extends vertically ans upwardly through aligned channels in U-bar 22 and draw bar 13. In the embodiment shown, the bolts 23 an each threadably received in the upper flange of the U-bar 22. Thus, the draw bar 13 is secured to the U-bar 22.

The plow apparatus 10 also includes a vertically extending post 20 that is located in rearwardly spaced relationship to the horizontal draw bar 13. To connect the draw bar 13 to the mid-region of the past 20, the rearward vertical face of bar 13 has a cross-sectionally rectangular sleeve type coupling member 16 welded or otherwise secured thereto. A connecting extender bar 17 is slidably and telescopically receivable in the open rear end of coupling member 16, and, when so received, horizontal channel 134 in bar 17 is alignable with holes 133 in member 16. A pin 136 is then extended through the aligned holes and retained in place by a clip 138, cotter key, or the like. Thus, a Reese-type of hitch coupling between a sleeve member 16 and a bar member 17 is achieved to provide a coupling means.

Figure 4:
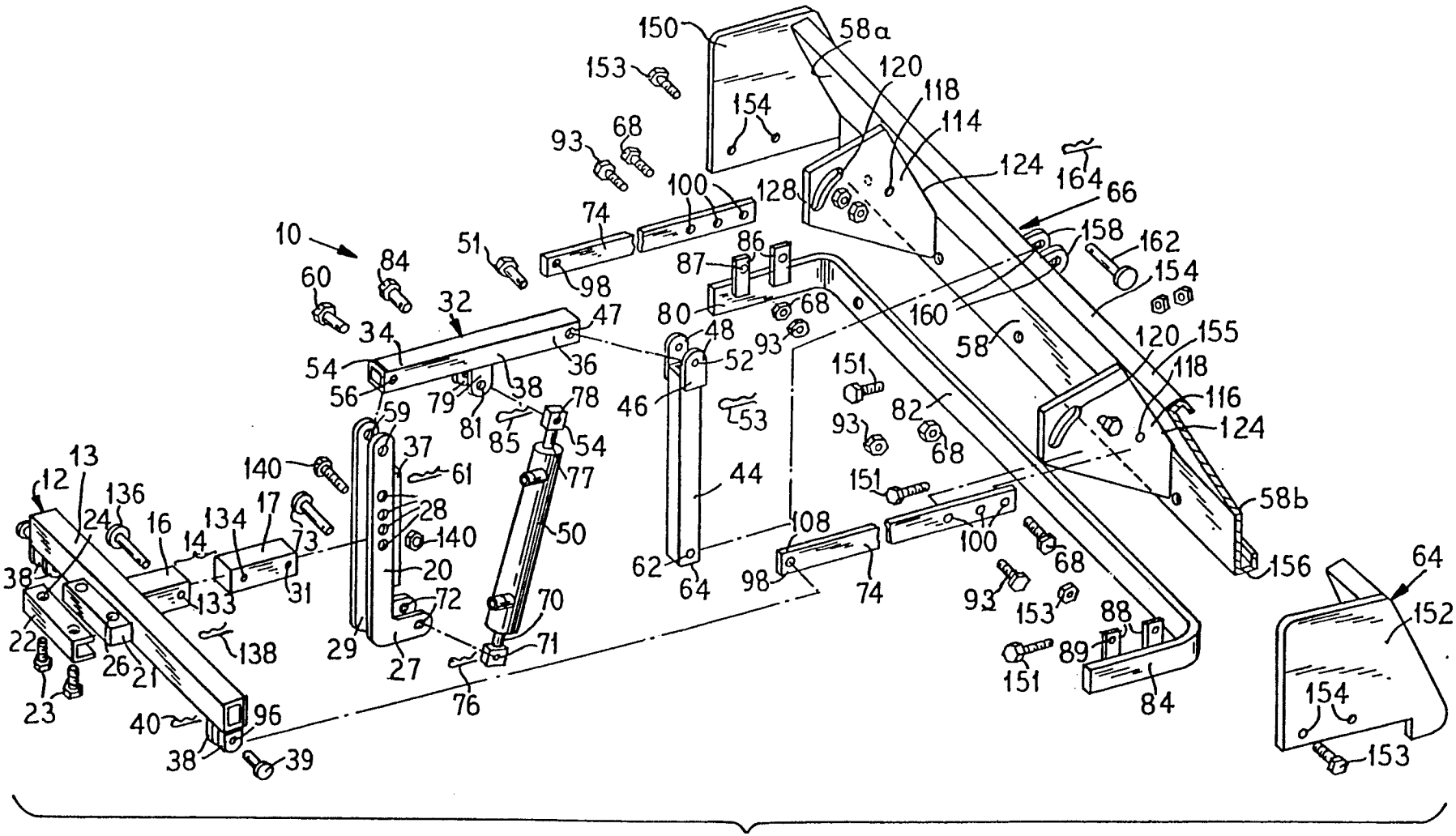
FIG. 4 an exploded perspective view of the pull plow of FIG. 1.

The post 20 utilizes a pair of transversely spaced, adjacent, parallel L-configured flat metal bars 27 and 29, as shown, for example, in FIG. 4. Across rear edge portions of bars 27 and 29, a retaining bracket plate 37 is fixed by welding or the like. The spacing between the bars 27 and 29 is such that bar 17 is slidable therein. A plurality of vertically spaced, transversely aligned hole pairs 28 are provided, one hole of each pair being in a different one of each of the bars 27 and 29. A bore or hole 31 is provided in a rear portion of bar 17. The bore 31 is alignable with individual single pairs of the holes 28. When bore 31 is thus aligned with and between one pair of holes 28, a nut and bolt assembly 140 is extended therethrough and used to hold bar 17 in engaged association with the post 20.

Thus, the height of post 20 relative to cross bar 13 is selectively adjustable by this clevis-type arrangement. Consequently, the position of post 20 is positively set and yet past 20 is adjustable vertically so that in use the possibility of slippage of post 20 relative to draw bar 13 is eliminated, thereby avoiding misalignment.

The draw bar 13, the post 20 and the interconnecting assembly including coupling member 16 and extender bar 17 are part of the plow stabilizing and supporting subassembly 12 of the plow apparatus 10 which connect the apparatus 10 to the rear end of a vehicle 11. Those skilled in the art will appreciate that the subassembly 12 can be connected (i.e., coupled) to a vehicle 11 by various means.

The plow apparatus 10 also employs a plow elevating subassembly 32. This subassembly 32 employs a pair of relatively rigid, elongated, flattened stabilizing arms 74. Each arm 74 is pivotally joined at its respective opposite ends between a different end of the draw bar 13 and a respective rearward portion of a different plate support 114 or 116 by pivotal joining means. Thus, the plate supports 114 and 116 are each longitudinally aligned with a different opposite end of draw bar 13. On the bottom face of draw bar 13 at each opposite end thereof, a pair of transversely spaced, adjacent flanges 38 is mounted by welding or the like. The flanges 38 each have an aperture 96 therein. Also, the rearward end of each arm 74 has an aperture 98 therein. When the rearward end of each arm 74 is positioned between each flange pair 38 and is joined thereto by an interconnecting pin 39 (and associated retaining chip 40) that extends through aligned apertures 96 in flanges 38 and apertures 98 in each arm 74, pivotal movement is achieved. The opposite end of each arm 74 is provided with a plurality of longitudinally spaced holes 100. When the opposite end of each arm 74 is positioned adjacent one of the plates 114 and 116 near the rear edge 124 thereof and is aligned with a hole 118 in each plate 114 and 116, a nut and bolt assembly 68 can be associated therewith and pivotal movement therebetween is achieved.

The plow elevating subassembly 32 also incorporates a pair of articulated elongated links 34 and 44. The adjacent ends 36 and 46 of links 34 and 44 are pivotally interconnected. Thus, in embodiment 10, link end 36 is provided with a channel 47 and link end 46 is provided by welding or the like with a pair of projecting flanges 48 between which link end 36 is slidable. When a pin 51 is extended through holes 52 in flanges 48 that are aligned with channel 47, pivotal articulation between links 44 and 34 is achieved. A chip 53 retains the pin 51 in the desired association.

End 54 of link 34 is provided with a hole 56. The spacing between L-bars 27 and 29 is adapted to slidably accommodate end 54. When holes 59 in the upper end of L-bars 27 and 29 are aligned with hole 56 and a pin 60 is extended therethrough and locked with clip 61, link 34 is pivotally associated with post 20.

End 64 of link 44 is provided with a hole 62. Thus, the upper and lower edges of blade member 58 are each preferably formed with elongated rear turned U-configured reinforcing flanges 155 and 156, respectively. To the upper mid-region of the blade member 58 on face 58B below rear turned flange 155 is mounted by welding or the like a pair of spaced flanges 158 which each have a longitudinally aligned (relative to the other) aperture 160 formed therein. The spacing between flanges 158 slidably accommodates end 64. When apertures 160 in flanges 158 are aligned with hole 62, and a pin 162 is extended therethrough and locked with clip 164, link 44 is pivotally associated with blade member 58.

The plow elevating subassembly 32 further incorporates a fluidic cylinder 50 (preferably hydraulic). In the cylinder 50 shown, the lower, sealed end of cylinder 50 has a projecting mounting stem 70 that terminates in an eyelet 71. Eyelet 71 is pivotally joined to the lower (opposite) rear protruding end portion of post 20.

Thus, eyelet 71 is positioned between L-bars 27 and 29 and is aligned with holes 72 in each lower outward end of the L-bars 27 and 29. When the holes 72 are aligned with the eyelet 71 and a pin 73 is extended therethrough and locked with clip 76, the lower end of cylinder 50 is pivotally associated with post 20.

The upper end of cylinder 50 is provided with a fluidically extensible and retractable push rod 77 which at its outer end terminates in an eyelet 78. The lower mid-region of link 34 is provided with a pair of adjacent spaced flanges 79 mounted thereto by welding or the like, and each flange is provided with an aperture 81. When eyelet 78 is positioned between flanges 79 and aligned with the apertures 81, and a pin 84 is extended therethrough and locked with a clip 85, the push rod 77 is pivotally associated with link 34.

Extension and retraction of the push rod 77 relative to the body of cylinder 50 produces raising and lowering, respectively, of the plow subassembly 66.

Various fluid connecting conduit arrangements can be employed. Illustratively, in embodiment 10, hydraulic fluid is input through conduit 142 that is joined to the lower end of cylinder 50 in order to extend rod 77, while fluid is withdrawn from the upper end of cylinder 50 through a conduit 144 that is joined to the upper end of cylinder 50 in order to retract rod 77. Conduits 142 and 144 connect with hydraulic fluid pressurizing pump and control apparatus 146 and 148, respectively (conventional).

Embodiment 10 features the incorporation of cooperative, non-interfering means for plow orientation adjustment. Plow tilt regulating is accomplished by providing a substantially arcuate slot 120 in a forward portion of each one of the plate supports 114 and 116. In addition, one of the apertures 100 in each one of the stabilizer arms 74 is located so as to be in aligned relationship with the adjacent one of the arcuate slots 120. An adjustable clamping means, such as a nut and bolt assembly 93, extends through each aligned aperture 100 and adjacent slot 120 so that each slot 120 is associated with an aperture 100 of a different arm 74. Thus, the respective arms 74 are each clampable by a nut and bolt assembly 93 to an associated one of the plates 114 and 116 so that a desired tilt angle is achievable for plow assembly 66. The plow subassembly 66 is thus positionable at a particular or predetermined tilt angle.

Plow height regulating is accomplished by selecting one of hole pairs 28 to align with hole 31, as explained above, and inserting bolt 140. Height regulation may need to be accomplished when associating a plow apparatus 10 with a particular vehicle 11 or under field conditions (for example, to maintain the scraper bar 82 in a desired ground resting configuration along its entire length in a given plowing operation). During plowing, the cylinder 50 can be maintained in a fluidically relaxed configuration, if desired, to provide some resiliency for the plow subassembly 66 and scraper bar 82 as they move over a ground surface.

Although only one embodiment of this invention has been shown and described, it is to be understood that various modifications and substitutions as well as rearrangements and combinations of the preceding embodiment can be made by those skilled in the art without departing from the novel spirit and scope of this invention.

What is claimed is:

1. An improved universal adjustable snow plow apparatus that is connectable to a vehicular rear for plowing comprising in combination:

(a) plow means comprising horizontal blade means and a pair of vertically oriented horizontally spaced plate support means attached to the front face thereof;

(b) plow stabilizing and supporting means connectable to a vehicular rear including horizontal draw bar means and vertical post means;

(c) plow elevating means comprising:

(1) a pair of rigid horizontally spaced stabilizing arms that are pivotably joined between said draw bar means and a different respective one of said plate support means, (2) a pair of articulated links pivotally joined between an upper end region of said post means and an upper portion of said blade means, and (3) fluidic cylinder means pivotally joined between said post means and one of said links, and including fluid pressurizing means for said cylinder means, for raising and lowering said plow means; and (d) plow orientation adjustment means comprising tilt regulating means and plow height regulating means.

2. The plow apparatus of claim 1 wherein said tilt regulating means comprises:

(a) a substantially arcuate slot defined in a forward portion of each one of said plate support means;

(b) aperture means defined in each one of said stabilizer arms in aligned relationship with the adjacent one of said slot means; and (c) adjustable clamping means interconnecting each said slot means with the adjacent said aligned aperture means.

3. The plow apparatus of claim 2 wherein said height regulating means comprises:

(a) a plurality of vertically spaced first hole means defined in said post means;

(b) second hole means defined through the outer end of said longitudinal connecting means adjacent said post means and in alignable relationship with each one of said first hole means; and (c) retaining pin means extendable through both said second hole means and concurrently a selected one of said first hole means.

4. The plow apparatus of claim 1 wherein said plow means further includes a replacable elongated scraper bar with forwardly turned portions at respective opposite ends thereof extending along lower edge portions of said blade means and said side walls and including detachable attachment means for attaching said scraper bar to said blade means and said side walls.

5. An improved universal adjustable snow plow apparatus that is connectable to a vehicular rear for plowing comprising in combination:

(a) plow means comprising horizontal blade means and a pair of vertically oriented horizontally spaced plate support means attached to the front face thereof;

(b) plow stabilizing and supporting means comprising (1) a horizontal draw bar means, (2) a vertical post means, (3) coupling means between said draw bar means and said post means including vertically adjustable clevis means for height adjustment of said post means relative to said draw bar means, and (4) means for connecting said draw bar means to a vehicular rear;

(c) plow elevating means comprising:

(1) a pair of rigid horizontally spaced stabilizing arms that are pivotably joined between said draw bar means and a different respective one of said plate support means, (2) a pair of articulated links pivotally joined between an upper end region of said post means and an upper portion of said blade means, and (3) fluidic cylinder means pivotally joined between said post means and one of said links, and including fluid pressurizing means for said cylinder means, for raising and lowering said plow means; and (d) orientation adjustment means for said plow blade means comprising tilt adjustment means for regulating the inclination angle between said stabilizing arms and said plate support means.

6. The plow apparatus of claim 5 wherein, in said stabilizing and supporting means, said coupling means comprises a sleeve member centrally secured to said draw bar means, a bar member that slidably engages said sleeve member, and pin means passing through said sleeve member and said bar member.

7. The plow apparatus of claim 5 wherein said tilt adjustment means comprises:

(a) a substantially arcuate slot defined in a forward portion of each one of said plate support means;

(b) aperture means defined in each one of said stabilizer arms in aligned relationship with the adjacent one of said slot means; and (c) adjustable clamping means interconnecting each said slot means with the adjacent said aligned aperture means.

8. The plow apparatus of claim 7 wherein said height regulating means comprises:

(a) a plurality of vertically spaced first hole means defined in said post means;

(b) second hole means defined through the outer end of said longitudinal connecting means adjacent said post means and in alignable relationship with each one of said first hole means; and (c) retaining pin means extendable through both said second hole means and concurrently a selected one of said first hole means.

9. The plow apparatus of claim 5 wherein said plow means further includes a replaceable elongated scraper bar with forwardly turned portions at respective opposite ends thereof extending along lower edge portions of said blade means and said side walls and including detachable attachment means for attaching said scraper bar to said blade means and said side walls.

10. An improved universal adjustable snow plow apparatus that is connectable to a vehicular rear for plowing comprising in combination:

(a) plow means comprising:

(1) a horizontally elongated blade means having a front face and a back face, (2) a pair of side walls, each one vertically mounted at a different opposite end of said blade means, including mounting means therefor, and said side walls together defining with said blade means a material collecting region during plowing, and (3) a pair of forwardly projecting, vertically oriented plate support means, each having front edge portions and back edge portions, and each one being secured along said back edge portions thereof to said front face in horizontally spaced relationship to the other thereof, including securing means therefor;

(b) plow stabilizing and supporting means connectable to a vehicular rear including:

(1) a horizontally extending draw bar means, and (2) a vertically extending post means in rearwardly spaced relationship to said draw bar means and including longitudinal connecting means therefor;

(c) plow elevating means comprising:

(1) a pair of rigid stabilizing arms, each one being pivotably joined between a different respective one end of said draw bar means and a rearward portion of one of said plate support means and including pivotal joining means therefor, (2) a pair of articulated end adjoining links having an opposite end of one of said links pivotally joined to an upper end region of said post means and an opposite end of the other of said links pivotally joined to a mid upper portion of said blade means and including pivotal joining means therefor, and (3) fluidic cylinder means one end of which is pivotally joined to a lower opposite end region of said post means and the opposed end thereof being pivotally joined to a mid-region of said one link, and including fluid pressurizing means for said cylinder means and also pivotal joining means therefor;

so that said plow means is raisable and lowerable in response to fluid input and output in said cylinder means; and (d) plow orientation adjustment means comprising:

(1) plow means tilt regulating means comprising:

(a) an arcuate slot defined in a forward portion of each one of said plate support means, (b) aperture means defined in each one of said stabilizer arms in aligned relationship with the adjacent one of said slot means, and (c) adjustable clamping means interconnecting each said slot means with the adjacent said aligned aperture means, so that said plow means is positionable at a particular tilt angle, and (2) plow means height regulating means comprising:

(a) a plurality of vertically spaced first hole means defined in said post means, (b) second hole means defined through the outer end of said longitudinal connecting means adjacent said post means and in alignable relationship with each one of said first hole means, and (c) retaining pin means extendable through both said second hole means and concurrently a selected one of said first hole means, so that the height of said plow means is selectable.

11. The plow apparatus of claim 10 wherein said plow means further includes a replaceable elongated scraper bar with forwardly turned portions at respective opposite ends thereof extending along lower edge portions of said blade means and said side walls and including detachable attachment means for attaching said scraper bar to said blade means and said side walls.

12. A pull plow apparatus for use with a motor vehicle connectably coupled to a rear hitch for plowing near a structure, comprising:

a plow support assembly connectably coupled to a vehicle for stabilizing and supporting the plow during travel and plowing operations;

a mechanism for raising the plow during travel and lowering said plow for plowing a surface, including:

a first vertical support having an upper section, a middle section and a lower section, said middle section including means for selectively altering the position of the plow and maintaining said plow in a selected position relative to said vehicle having a plurality of apertures, said altering and maintaining means being coupled to said plow support assembly;

a pivot arm having a proximal section, a distal section and a middle section therebetween, said proximal section of the pivot arm pivotally connected to said upper section of the first vertical support and said distal section pivotally connected to a second vertical support whereby the pivot movement of said pivot arm raises said second vertical support as said pivot arm is raised and lowers said second vertical support as said pivot arm is lowered;

said second vertical support having an upper portion and a lower portion; and a hydraulic cylinder connected at one end to the lower section of said first vertical support and at the other end connected to the middle section of said pivot arm for raising and lowering said pivot arm;

said plow further including an elongated frame member connected to said second vertical support for responding to the raising and lowering thereof, including a front section and rear section, and a first end section, a second end section and a middle section therebetween, said end sections extending outwardly from the front section of said frame member to catch material between said frame member and said end sections thereof, fulcrum means for adjusting the tilt of the frame member with respect to a surface to be scraped extending outwardly and laterally across a substantial portion of said front section of said frame member, and scraper means for scraping the surface removably coupled to and along a bottom portion of said frame member;

linkage means adjustably coupled to said fulcrum means at one end and pivotally connected to said plow support assembly at the other end, whereby said linkage means partially supports said frame member during travel and pulls said frame member during plowing operations;

said second vertical support is pivotally connected to the rear section of said frame member whereby as said frame member is raised said frame member is partially tilted forward to remove material therefrom and whereby when said frame member is lowered said frame member is tilted backward adjacent to the surface to catch material to be plowed.

* * * * *